US006019709A

United States Patent [19]

Piaget

[11] Patent Number: 6,019,709

[45] Date of Patent: Feb. 1, 2000

[54] STRIDING EXERCISER WITH ADJUSTABLE UPWARDLY CURVED TRACKS

[76] Inventor: Gary D. Piaget, 3390 American Saddler Dr., Park City, Utah 84060

[21] Appl. No.: 08/799,911

[22] Filed: Feb. 13, 1997

[51] Int. Cl.[7] ..... A63B 22/00

[52] U.S. Cl. ..... 482/70; 482/51; 482/908

[58] Field of Search ..... 482/51, 52, 57, 482/70, 71, 79–80, 908; D21/193, 192, 191

[56] References Cited

U.S. PATENT DOCUMENTS

| | | | |
|---|---|---|---|
| 219,439 | 9/1879 | Blend . | |
| D. 358,436 | 5/1995 | Piaget et al. . | |
| 4,176,836 | 12/1979 | Coyle . | |
| 4,492,374 | 1/1985 | Lekhtman et al. | 482/79 |
| 5,147,257 | 9/1992 | Loane . | |
| 5,336,141 | 8/1994 | Vitrone . | |
| 5,374,228 | 12/1994 | Buisman et al. . | |
| 5,833,584 | 11/1998 | Piaget et al. | 482/70 |
| 5,855,538 | 1/1999 | Argabright | 482/70 |

*Primary Examiner*—Stephen R. Crow
*Attorney, Agent, or Firm*—Barlow, Josephs & Holmes, Ltd.

[57] ABSTRACT

A curved track striding exercise device includes a movable track assembly wherein the curved tracks can be rotatably inclined or declined relative to the base, to simulate either an uphill or downhill striding arrangement. The striding exercise device includes an arcuate track assembly including a pair of spaced elongated, parallel tracks which curve upwardly in an arc, a pair of foot skates respectively movably supported on the parallel tracks for receiving the feet of an operator thereon, and a base assembly for supporting the arcuate track assembly. The track assembly is cradled within the base and is slidably rotatable relative to the base about a pivot point which is located above the base. Rotation of the track assembly is guided in a plane which is generally parallel to the tracks, whereby the track assembly is selectively movable between a first angular position wherein the tracks are inclined relative to the supporting surface to simulate uphill striding, and a second angular position wherein the tracks are is declined relative to the supporting surface to simulate downhill striding.

15 Claims, 7 Drawing Sheets

STRIDING EXERCISER WITH ADJUSTABLE UPWARDLY CURVED TRACKS

BACKGROUND AND SUMMARY OF THE INVENTION

The instant invention relates to exercise apparatus and more particularly to a striding exerciser having rotatably adjustable upwardly curved tracks.

Striding exercisers with upwardly curved tracks have heretofore been known in the art. In this regard, the U.S. Pat. to Piaget et al No. 5,575,740 represents the closest prior art to the subject invention of which the applicant is aware. The '740 patent discloses an exercise device comprising a base having two parallel upwardly curved tracks, and two foot skates which are rotatably supported on the tracks. Although the device in the '740 patent has been scientifically proven to be highly effective for aerobic conditioning and calorie burning, there is one noted disadvantage in the specific design of the prior device. This disadvantage relates to noise levels created by the hollow blow-molded base. The movement of the skate wheels on the hollow base tends to echo during use, and creates unwanted noise. Accordingly, there is a perceived need in the industry to overcome this drawback. Furthermore, there is always an ongoing need in the industry for improved and updated apparatus which offer additional features, functionality, and flexibility in exercise regimen.

The instant invention provides a striding exercise device having upwardly curved tracks wherein the curved tracks can be rotatably inclined or declined relative to the supporting surface to simulate either uphill or downhill striding. More specifically, the striding exercise device includes an arcuate track assembly including a pair of spaced elongated, parallel tracks which curve upwardly in an arc, a pair of foot skates respectively movably supported on the parallel tracks for receiving the feet of an operator thereon, and a base assembly for supporting the arcuate track assembly above a supporting surface.

The track assembly includes four spaced, parallel, curved rails, divided into two pairs of rails which define the tracks described hereinabove. The rails are preferably of tubular steel construction and are maintained in spaced relation by two end members which are secured to the terminal ends of the rails. Each pair of rails supports a respective foot skate, each of which is rotatably supported on the respective pair of rails by two pairs of rubber skate wheels rotatably mounted to the foot skate body. The rubber skate wheels are virtually silent during movement on the tubular steel rails thereby offering a significant noise level improvement over the prior art design.

The track assembly still further includes an electronic console which is supported on an upright support member extending upwardly from the forward cross member. Even further still, two pivotable hand levers are rotatably attached to the upright support member to provide either a hand hold for the operator during use, or a means for exercising the upper body.

The base assembly comprises two spaced, parallel, curved, frame members that are maintained in spaced relation by two foot members which are secured to the terminal ends of the frame members. The base further includes two supporting cross members which extend transversely across a central portion of the base.

The track assembly is received on top of the cross members and is slidably support relative to the base assembly on top of the cross members. More specifically, the track assembly is slidably and rotatably movable on the cross members about a pivot point which is located above the base assembly. Rotation of the track assembly is guided in a plane which is generally parallel to the tracks by a slotted plate on the track assembly and guide rods on the cross-members. The track assembly is thus selectively rotatable between various angular positions wherein the tracks can be inclined relative to the supporting surface to simulate uphill striding, or declined relative to the supporting surface to simulate downhill striding.

In use, the operator stands on the foot skates, and reciprocates the foot skates back and forth along the upwardly curved tracks. The user may also pump the hand levers forwardly and rearwardly to provide additional upper body exercise, or may simply grasp the hand levers to provide stability.

In an alternate embodiment, the striding exercise device includes a motorized actuator assembly which is operative for selectively automatically controlling the angular position of the track assembly. In this manner, the device can be programmed to automatically change the angular position during use to achieve a full range of exercise in a single exercise routine.

Accordingly, among the objects of the instant invention are: the provision of a striding exerciser having upwardly curved tracks, and foot skates which are slidably movable along the tracks; the provision of a striding exerciser wherein the tracks are rotatably movable relative to the base to achieve an uphill or downhill striding arrangement; the provision of such a striding exerciser including a motorized actuator for selectively and/or automatically rotating the tracks relative to the base; the provision of a striding exerciser which is quiet in operation; the provision of a striding exerciser which collapses for ease of shipping and storage; and the provision of a striding exerciser which is relatively inexpensive to manufacture.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
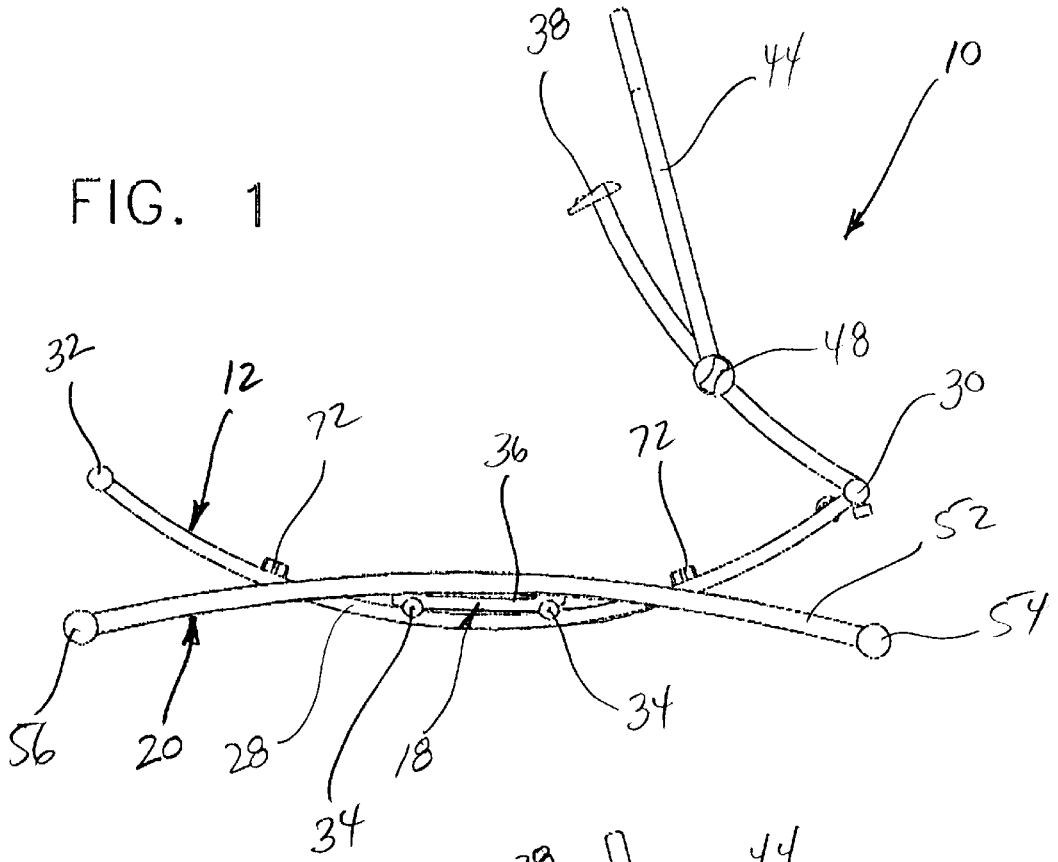
FIG. 1 is a side elevation view of the striding exercise device of the present invention.
Figure 2:
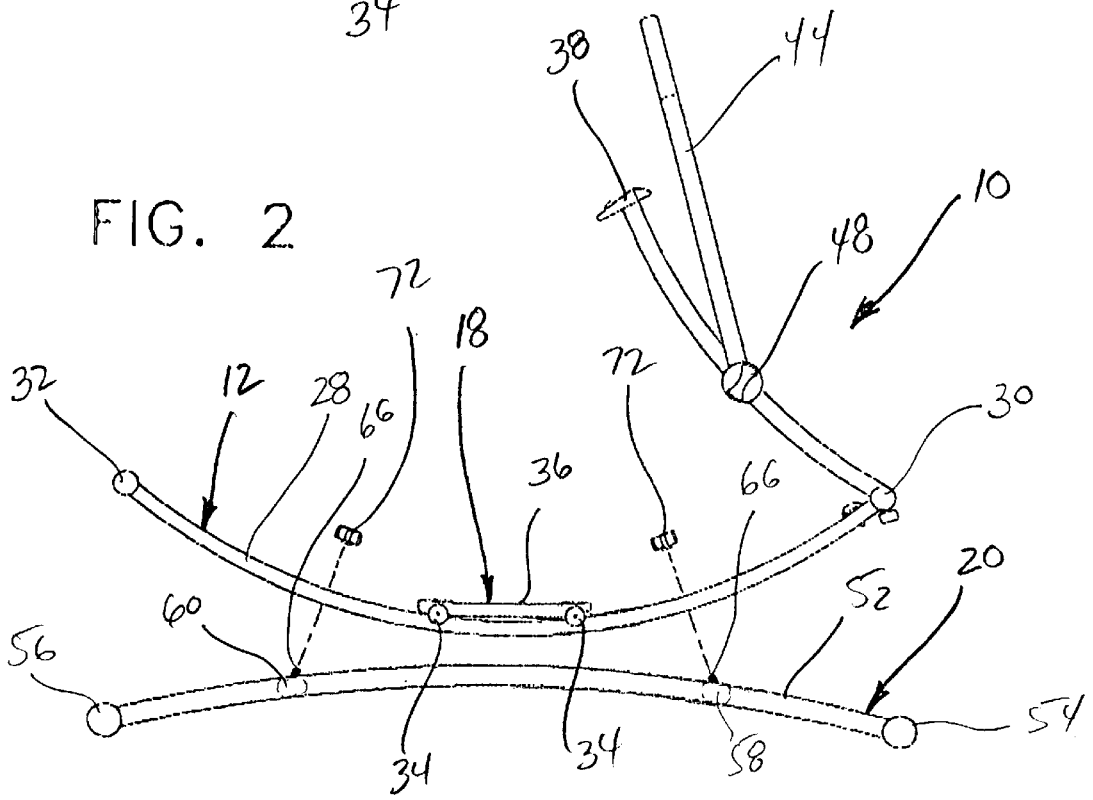
FIG. 2 is an exploded assembly view thereof.
Figure 3:
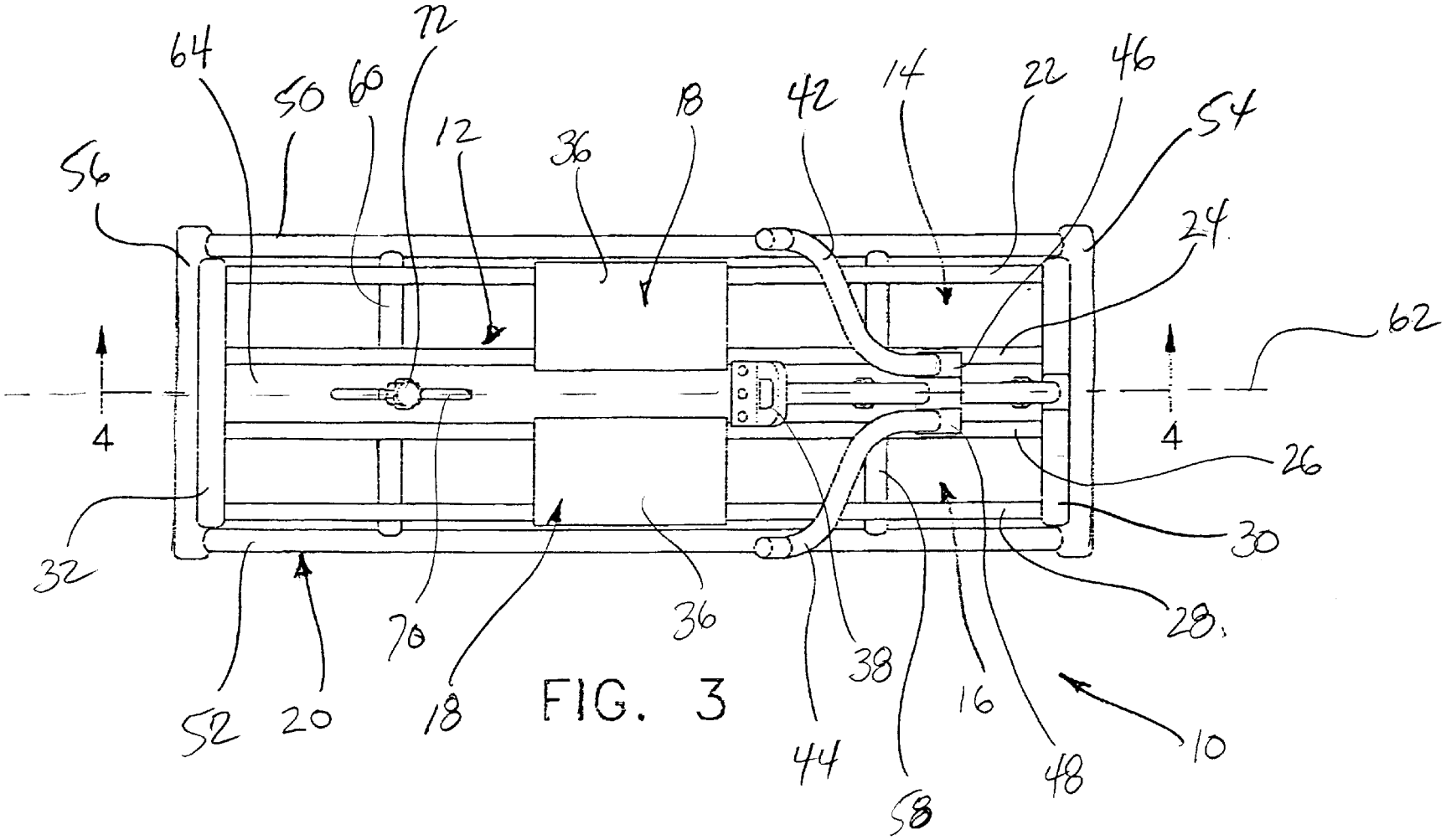
FIG. 3 is a top view thereof.
Figure 4:
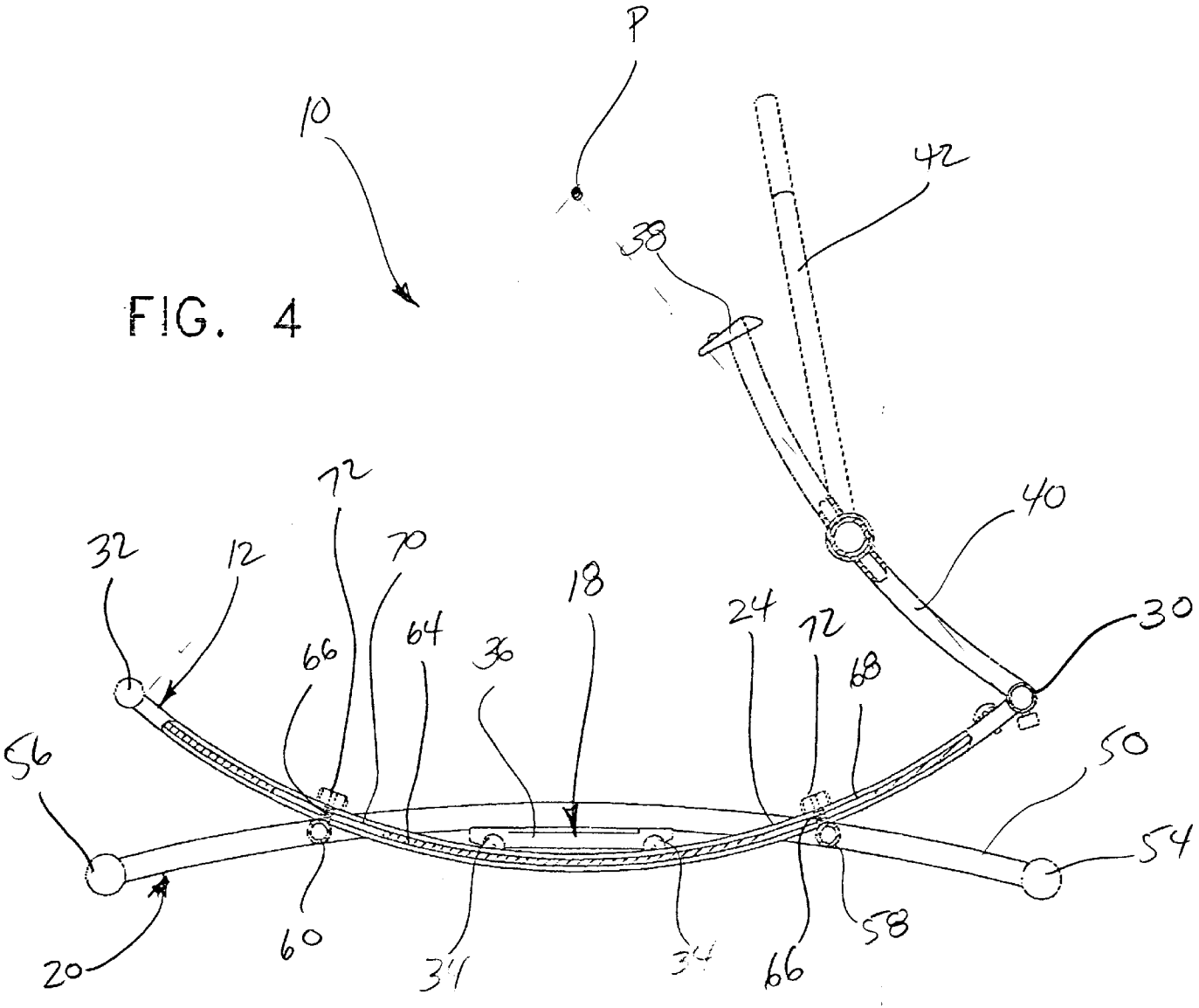
FIG. 4 is a cross-sectional view thereof taken along line 4—4 of FIG. 3.
Figure 5:
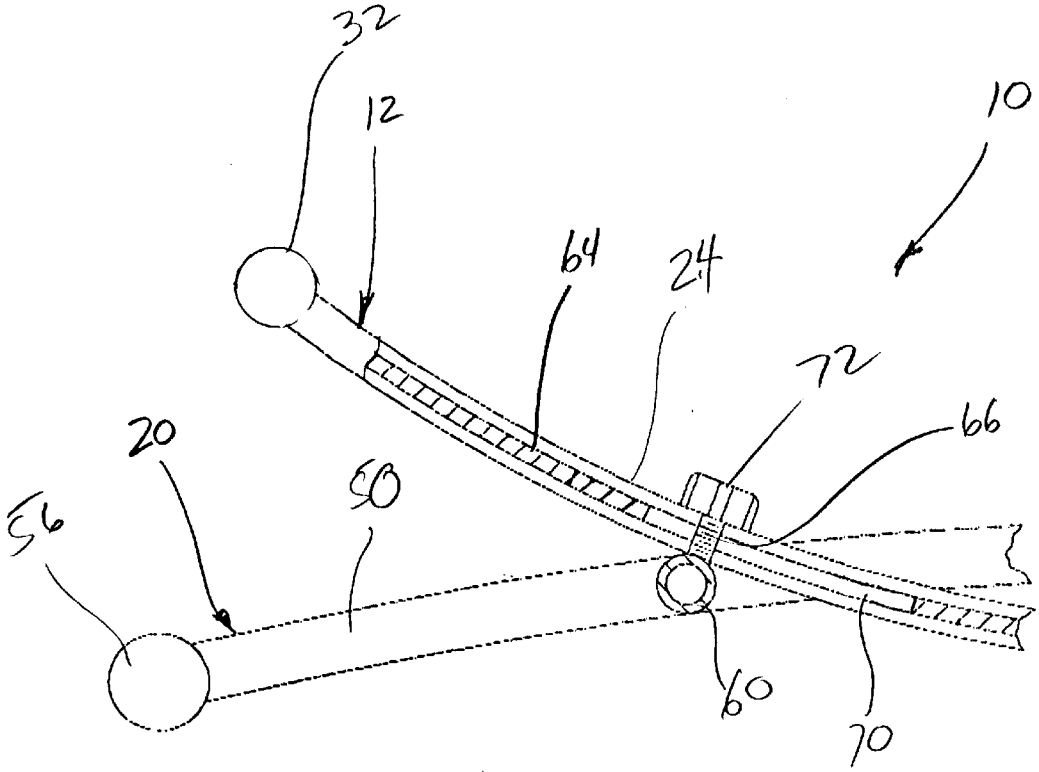
FIG. 5 is an enlarged cross-sectional view of the device showing sliding interconnection of the track assembly to the base assembly.
Figure 6:
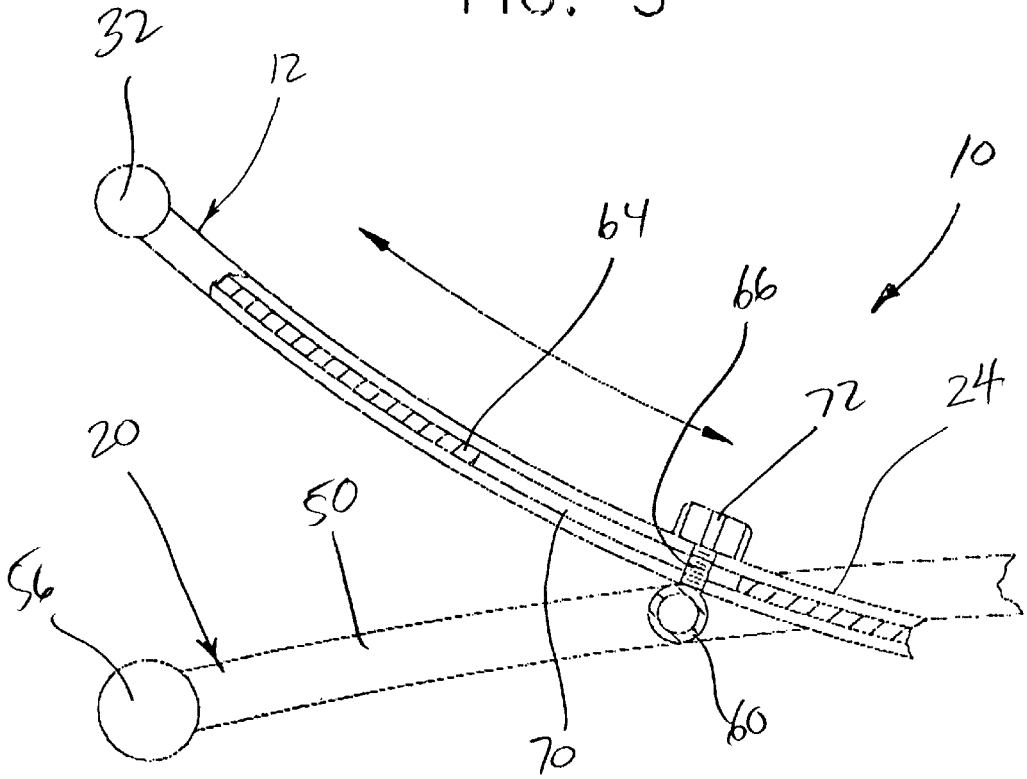
FIG. 6 is a similar view thereof showing sliding movement of the track assembly relative to the base assembly.
Figure 7:
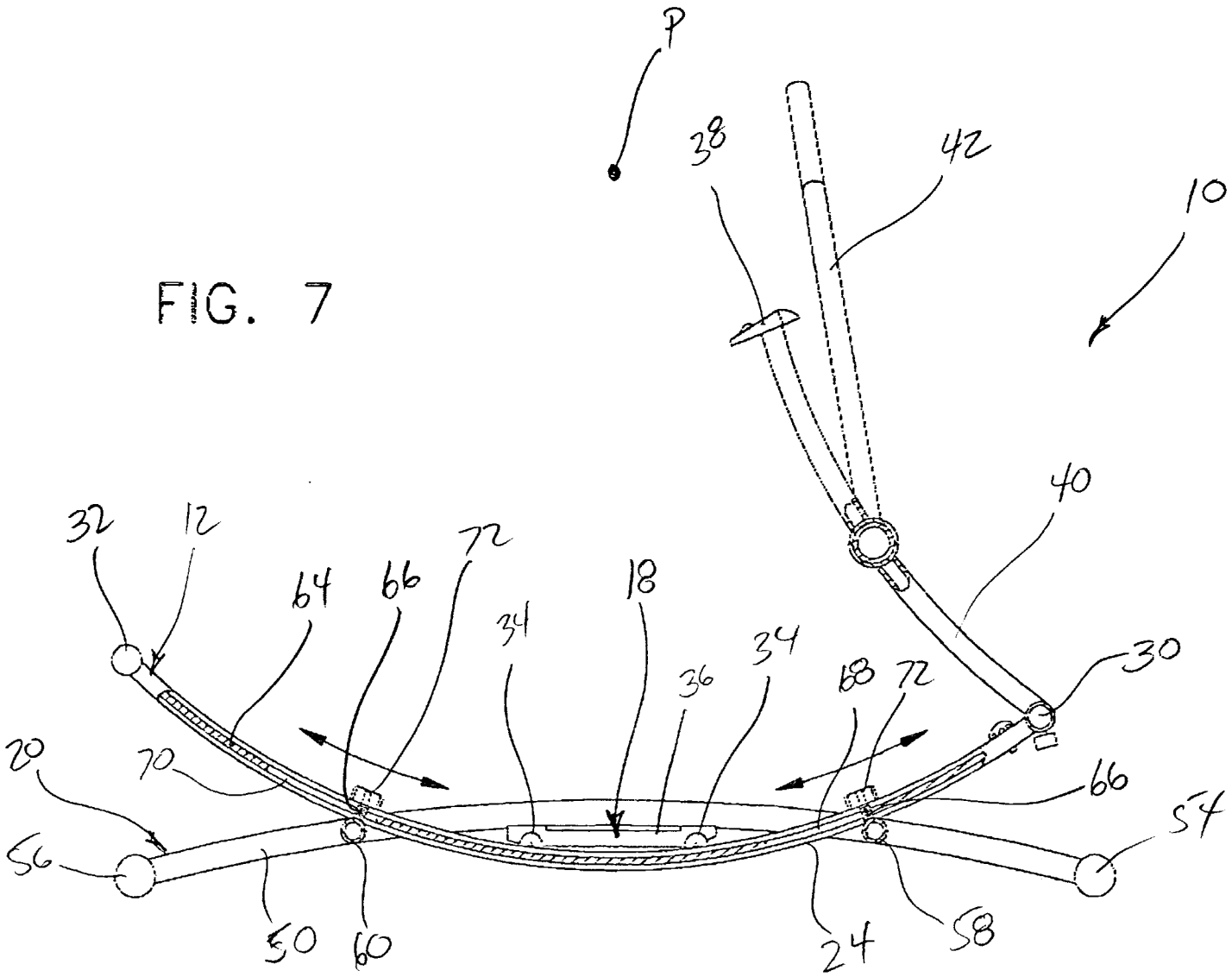
FIG. 7 is a side elevation view showing rotation of the entire track assembly about the pivot point.

Referring now to the drawings, the striding exercise device of the instant invention is illustrated and generally indicated at 10 in FIGS. 1–8. As will hereinafter be more fully described, the instant invention provides a striding exercise device 10 having upwardly curved tracks wherein the curved tracks can be rotatably inclined or declined relative to the supporting surface to simulate either uphill or downhill striding.

The striding exercise device 10 comprises an arcuate track assembly generally indicated at 12 including a pair of spaced elongated, parallel tracks generally indicated at 14, 16 respectively, a pair of foot skates generally indicated at 18 respectively movably supported on the parallel tracks 14, 16 for receiving the feet of an operator thereon, and a base assembly generally indicated at 20 for supporting the arcuate track assembly 12 above a supporting surface.

The track assembly 12 comprises four, spaced, parallel, curved rails 22, 24, 26, 28 respectively, which curve upwardly in a generally continuous arc. The rails 22, 24, 26, 28 are divided into two pairs of rails, 22, 24 respectively, and 26, 28 respectively, which define the tracks 14, 16 as described above. The 22, 24, 26, 28 rails are secured together and maintained in spaced relation by front and rear end members 30, 32 which are secured transversely across the terminal ends of the rails 22, 24, 26, 28. The rails 22, 24, 26, 28 and end members 30, 32 of the track assembly 12 are preferably fashioned from tubular steel, or other suitable structural materials to provide the stability and rigidity necessary to withstand the repeated stresses of day to day usage. The rails 22, 24, 26, 28 and end members 30, 32 are also preferably welded together to provide strong stable construction, and a clean appearance.

Each track 14, 16 supports a respective foot skate 18 which is rotatably supported on the respective rails 22, 24, 26, 28 by four rubber skate wheels 34 (two pairs) rotatably mounted to the foot skate body 36. The skate wheels 34 have a concave engaging surface (not shown) which rests on top of the tubular rails 22, 24, 26, 28 and prevents side to side movement of the foot skate 18 relative to the rails. The foot skate bodies 36 are constructed in accordance with known technology and design, and will not be described further herein.

The track assembly 12 still further includes an electronic console assembly 38 which is mounted on an upright support member 40 extending upwardly from the forward end member 30. The support member 40 is preferably rotatably mounted to the forward end member 30 to allow the support member 40 to be folded upwardly for use and downwardly for shipping and storage. The electronic console assembly 38 provides standard exercise information such as time or workout, calories burned, etc. etc, in a readable format for the user.

The track assembly 12 still further includes two pivotable hand levers 42,44 respectively which are rotatably attached to pivot assemblies 46, 48 mounted on the upright support member 40. These hand levers 42,44 can be locked in a stationary position to provide a stable hand hold for the operator during use, or can be unlocked and pivoted forwardly and rearwardly for exercising the upper body.

The base assembly 20 comprises two spaced, parallel, curved, frame members 50, 52 that are maintained in spaced relation by front and rear foot members 54, 56 which are secured to the terminal ends of the frame members 50, 52 at each end thereof. The base assembly 20 further includes front and rear supporting cross members 58, 60 which extend transversely across a central portion of the base assembly 20. The frame members 50, 52, foot members 54, 56, and cross members 58, 60 are all constructed from welded tubular steel members to provide a rigid, durable construction.

Referring to FIGS. 1–4, the entire track assembly 12 is received in nested relation within the framework of the base assembly 20. More specifically, the curved rails 22, 24, 26, 28 of the track assembly 12 rest in nested relation on top of the cross members 58, 60 of the base assembly 20 and are slidably supported relative to the base assembly 20 on the cross members 58, 60. In this regard, the overall exterior width of the track assembly 12 is somewhat smaller than the interior width of the frame members 50, 52 of the base assembly 20 so that the track assembly 12 fits within the interior of the base assembly 20. Referring to FIGS. 4–7, the track assembly 12 is slidably and rotatably movable relative to the base assembly 20 about a pivot point P which is located above the base assembly 12. In this regard, the track assembly 12 is rotatable between a first angular position (FIG. 5) wherein the tracks 14, 16 are inclined relative to the supporting surface to simulate a uphill or inclined striding, and a second angular position (FIGS. 4 and 7) wherein the tracks 14, 16 are declined relative to the supporting surface to similar downhill or declined striding.

Rotation of the track assembly 12 relative to the base assembly 20 is guided in a plane 62 (shown in broken line in FIG. 3) which is parallel to the longitudinal extent of the tracks 14, 16 by a curved, slotted plate generally indicated 64 on the track assembly 12 and corresponding guide rods 66 mounted on the cross-members 58, 60 of the base assembly 20. The slotted plate 64 extends along the center of the track assembly 12 between the inner rails 24, 26, and in this regard, the guide rods 66 on each of the cross members 58, 60 extend upwardly through respective front and rear longitudinal slots 68, 70 in the plate 64. The slots 68, 70 and guide rods 66 effectively guide movement of the track assembly 12 within the described plane 62 and further limit the extent of travel of the track assembly 12 relative to the base assembly 20.

The guide arrangement also operates as a means for selectively locking the track assembly 12 in a predetermined angular rotational position relative to the base assembly 20. In this regard, each of the guide rods 66 is threaded along the end portion thereof, and a corresponding threaded locking knob 72 is received onto each of the rods 66. The track assembly 12 can be locked into position by tightening the locking knobs 72 down into engagement with the upper surface of the slotted plate 64 wherein the slotted plate 64 will be frictionally captured between the locking knobs 72 and the cross members 58, 60.

In use of the device 10, the operator stands on the foot skates 18, and reciprocates the foot skates 18 back and forth along the upwardly curved tracks 14, 16. In accordance with the teaching of the prior art, the upward curvature of the tracks 14, 16 generally corresponds with the natural swinging arc of the operator's legs, and maintains the operators torso in a stationary and balanced position over the base assembly 20. The curvature of the tracks 14, 16 is therefore operative for immobilizing vertical movement of the operator's center of gravity during reciprocating movement of the feet. The curved tracks 14, 16 allow the user's legs to naturally pivot about the hip joint without requiring the legs to lift the body or torso upwardly with each stride. Because the legs are not required to lift the operator's weight, there is virtually no strain placed on the leg joints, especially the ankle, knee and hip joints. In addition, the curvature of the tracks 14, 16 reduces back strain associated with repetitive bending in flat rail striding devices. The combined effect is to eliminate physical stresses on the body while providing an effective aerobic workout. The user may also pump the hand levers 42, 44 forwardly and rearwardly to provide additional upper body exercise, or may lock the hand levers 42, 44 and simply grasp the hand levers 42, 44 to provide stability.

Figure 8:
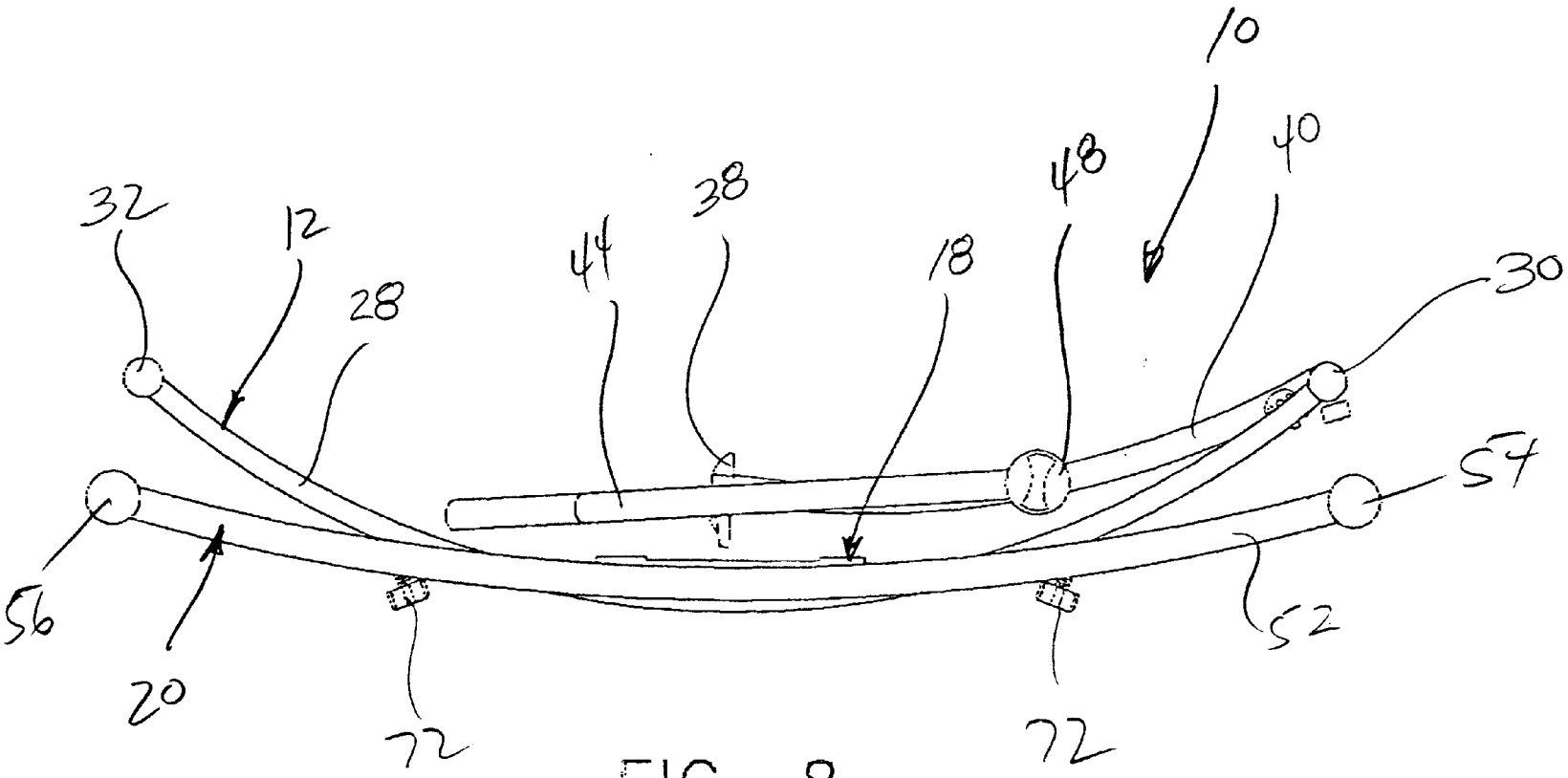
FIG. 8 is a side elevation view showing the striding exercise device folded down for shipping and storage.

Referring to FIG. 8, the provision of separate track and base assemblies 12, and 20, allows the device 10 to be knocked down to a relatively small size for shipping, handling and storage.

Figure 9:
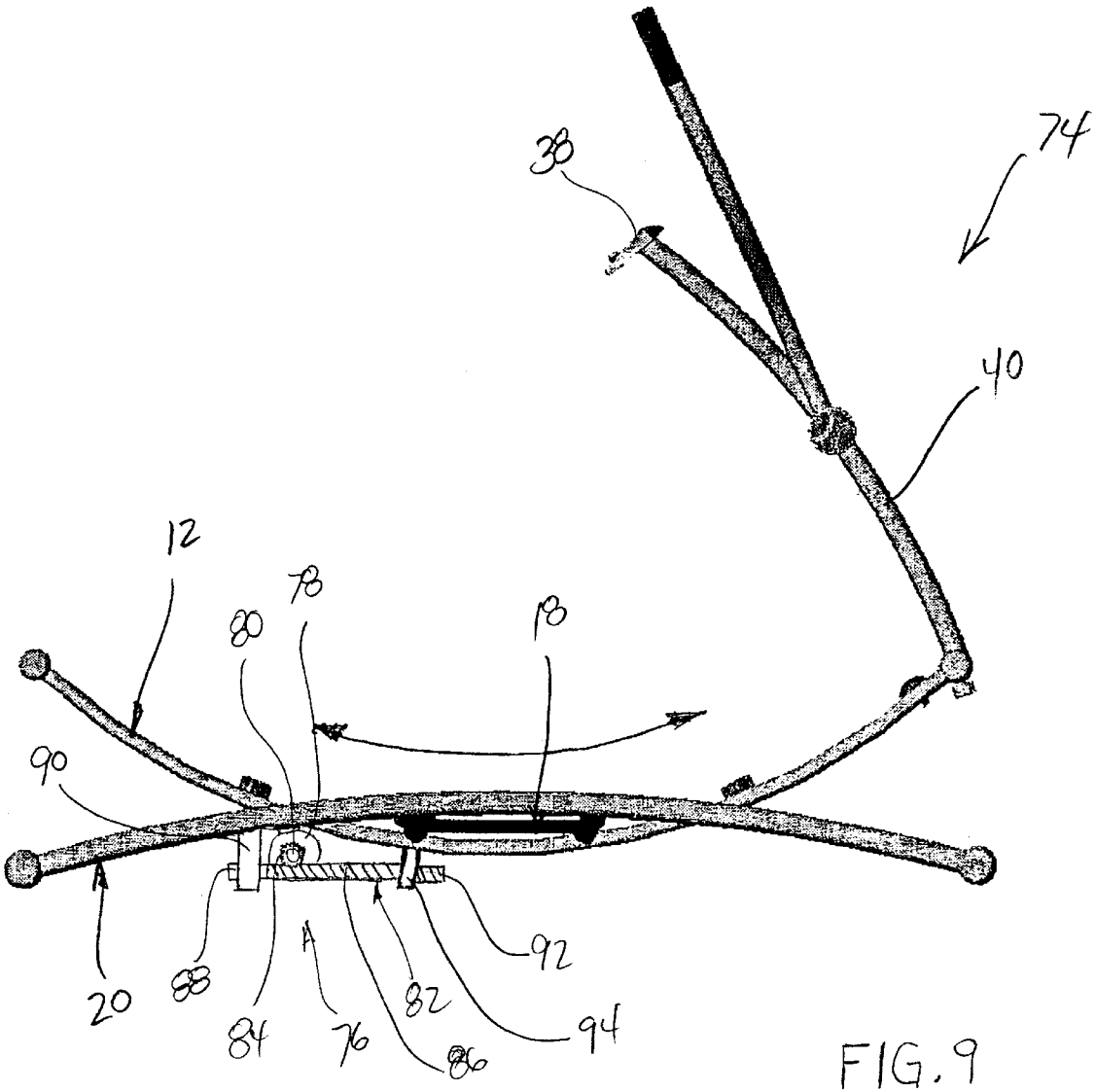
FIG. 9 is a side elevation view of an alternative embodiment including a motorized actuator for selectively automatically adjusting the rotation of the tracks.

Referring now to FIG. 9, an alternate embodiment of the exercise device is illustrated and generally indicated at 74. The striding exercise device 74 is generally identical to the first embodiment 10 as described above, with the exception of the manual lock knob arrangement, and in this regard, the present embodiment 74 will retain the same numbering scheme for the common elements the base assembly 20 and track assembly 12. In the present embodiment 74, the manual locking arrangement is replaced by a motorized actuator assembly generally indicated at 76 which allows automatic control of the angular position of the track assembly 12. In this manner, the control module assembly 38 can be wired to the motorized actuator assembly 76 and programmed to automatically change the angular position of the track assembly 12 during use to achieve a full range of exercise in a single exercise routine. The actuator assembly 76 comprises an electric drive motor 78 having a rotatable drive shaft 80, and a worm screw transfer assembly generally indicated 82. The drive motor 78 is mounted to the under side the base assembly 12 and the drive shaft 80 of the motor is provided with a conventional worm drive gear 84 for driving the worm screw transfer assembly 82. The worm screw transfer assembly 82 includes a worm screw 86 having an unthreaded first end portion 88 which is rotatably mounted in a bearing mount 90 also attached to the under side of the base assembly 12. The worm screw 86 further includes a second end portion 92 which is threadedly received through a pivotable threaded coupling 94 attached to the underside of the track assembly 12. The worm screw 86 is positioned so that the central threaded portion thereof engages with the worm drive gear 84 of the motor 78 such that rotation of the worm drive gear 84 causes corresponding rotation of the worm screw 86 and linear forward and rearward translation of the threaded coupling 94 and track assembly 12. The motor 78 is reversible to provide both forward and rearward translation of the track assembly 12. Accordingly, rotation of the worm screw 86 in one direction will cause forward translation of the track assembly 12 while rotation in the other direction will cause rearward translation.

The electronic control assembly 38 will provide the ability to selectively actuate movement of the track assembly 12 in either direction simply by pressing a corresponding button (not shown) on the control panel. Furthermore, the control electronics will also provide the ability to program different automatic movements of the track assembly 12 during an exercise routine. Accordingly, the device 74 will be able to automatically adjust to different angular positions during a programmed exercise routine. Pre-programmed exercise routines will be included, along with the ability for the user to personally customize track movements.

It can therefore be seen that the instant invention provides unique and improved exercise devices which provides added functionality over the prior art devices. The ability to adjust the angular position of the tracks 14,16 relative to the base assembly 20 provides added flexibility to exercise regimen and therefore increases the effective usable life of the product. The rubber skate wheels 34 and tubular steel construction of the rails 22, 24, 26, 28 is virtually silent during operation thereby offering a significant noise level improvement over the prior art design. Still further, the motorized actuator 76 for automatically changing the angular position of the track assembly 12 provides additional functionality to the device which was not available in the prior art devices. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A striding exercise device comprising:

a base;

a track assembly including a pair of spaced elongated, parallel tracks which curve upwardly in a continuous arc, said track assembly being received on said base, said base supporting said track assembly above a supporting surface, said track assembly being slidably rotatable in an arcuate path relative to said base between a first angular position wherein said track assembly is inclined relative to said base to provide inclined striding, and a second angular position wherein said track assembly is declined relative to said base to provide declined striding, said track assembly being slidably rotatable within a plane which is generally parallel to said tracks; and a pair of foot skates respectively movably supported in said parallel tracks for receiving the feet of an operator thereon, wherein the operator reciprocates said feet back and forth so that said foot skates move in reciprocating motion along said tracks.

2. The striding exercise device of claim 1 further comprising a positioning device for selectively positioning said track assembly in a fixed angular position relative to said base.

3. The striding exercise device of claim 1 wherein said positioning device includes an actuator for selectively actuating rotation of said track assembly relative to said base.

4. The striding exercise device of claim 2 wherein said positioning device includes an actuator for selectively actuating rotation of said track assembly relative to said base.

5. The striding exercise device of claim 3 wherein said positioning device includes a control for controlling said actuator.

6. The striding exercise device of claim 4 wherein said positioning device includes a control for controlling said actuator.

7. The striding exercise device of claim 3 wherein said actuator comprises a reversible drive motor having a rotatable drive shaft, and a transmission device connected between said drive shaft and said track assembly for translating rotation of said drive shaft into corresponding movement of said track assembly.

8. The striding exercise device of claim 4 wherein said actuator comprises a reversible drive motor having a rotatable drive shaft, and a transmission device connected between said drive shaft and said track assembly for translating rotation of said drive shaft into corresponding movement of said track assembly.

9. The striding exercise device of claim 5 wherein said actuator comprises a reversible drive motor having a rotatable drive shaft, and a transmission device connected between said drive shaft and said track assembly for translating rotation of said drive shaft into corresponding movement of said track assembly.

10. The striding exercise device of claim 6 wherein said actuator comprises a reversible drive motor having a rotatable drive shaft, and a transmission device connected between said drive shaft and said track assembly for translating rotation of said drive shaft into corresponding movement of said track assembly.

11. The striding exercise device of claim 1 wherein at least a portion of said continuous arc of said parallel tracks has a curvature generally corresponding to a swing arc of an operator's leg.

12. The striding exercise device of claim 2 wherein at least a portion of said continuous arc of said parallel tracks has a curvature generally corresponding to a swing arc of an operator's leg.

13. The striding exercise device of claim 3 wherein at least a portion of said continuous arc of said parallel tracks has a curvature generally corresponding to a swing arc of an operator's leg.

14. The striding exercise device of claim 4 wherein at least a portion of said continuous arc of said parallel tracks has a curvature generally corresponding to a swing arc of an operator's leg.

15. The striding exercise device of claim 5 wherein at least a portion of said continuous arc of said parallel tracks has a curvature generally corresponding to a swing arc of an operator's leg.

* * * * *